US005862978A

United States Patent [19]

Forrest

[11] Patent Number: 5,862,978

[45] Date of Patent: Jan. 26, 1999

[54] CERTIFIED MAILER ENVELOPE ASSEMBLY

[75] Inventor: Donald E. Forrest, Worthington, Ohio

[73] Assignee: Moore U.S.A. Inc., Grand Island, N.Y.

[21] Appl. No.: 993,154

[22] Filed: Dec. 18, 1997

[51] Int. Cl.[6] ..... B65D 27/00

[52] U.S. Cl. ..... 229/70; 229/69; 229/300

[58] Field of Search ..... 229/69, 70, 300, 229/305

[56] References Cited

U.S. PATENT DOCUMENTS

| | | | |
|---|---|---|---|
| 1,491,675 | 4/1924 | Conklin . | |
| 1,568,880 | 1/1926 | Conklin . | |
| 2,166,439 | 7/1939 | Johnson | 229/300 X |
| 2,824,685 | 2/1958 | Patton . | |
| 3,655,121 | 4/1972 | Ward . | |
| 3,937,492 | 2/1976 | Biron . | |
| 3,986,662 | 10/1976 | Luftig . | |
| 4,368,903 | 1/1983 | Jones . | |
| 4,429,827 | 2/1984 | Murray . | |
| 4,682,793 | 7/1987 | Walz . | |
| 5,104,036 | 4/1992 | Rutkowski et al. . | |
| 5,183,203 | 2/1993 | Sanders . | |
| 5,190,210 | 3/1993 | Walz . | |
| 5,213,258 | 5/1993 | Kim | 229/305 |
| 5,271,553 | 12/1993 | Kim | 229/305 X |
| 5,316,208 | 5/1994 | Petkovsek . | |
| 5,346,124 | 9/1994 | Chess . | |
| 5,501,393 | 3/1996 | Walz . | |
| 5,507,526 | 4/1996 | Petkovsek . | |
| 5,752,647 | 5/1998 | Schubert et al. | 229/300 X |

OTHER PUBLICATIONS

"Commercial Ferrarelli, Inc. Return Receipt envelope, photocopy, admitted prior art," No Date.

*Primary Examiner*—Jes F. Pascua
*Attorney, Agent, or Firm*—Nixon & Vanderhye, P.C.

[57] ABSTRACT

An envelope assembly that is particularly suitable for return receipt requested mail (such as certified or registered mail) mounts the return receipt on a body portion of the envelope, opposite the envelope flap. The body portion and flap typically have tractor drive strips so that they can be processed by automatic printing equipment, and the return receipt is connected to the envelope in such a way that there is a minimal chance of the return receipt being "chewed up" by the printer or other handling equipment. The outgoing address is provided on the flap, and certified mail indicia may extend between the flap and the body of the envelope.

20 Claims, 2 Drawing Sheets

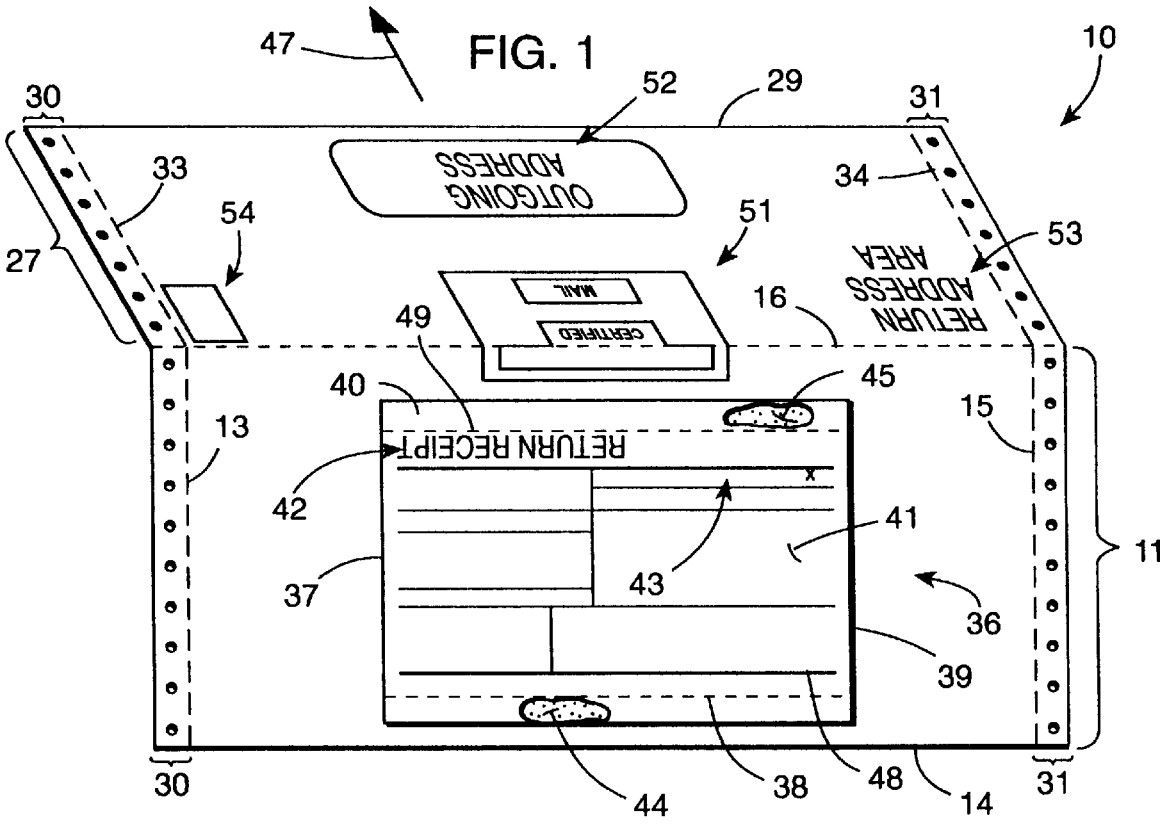
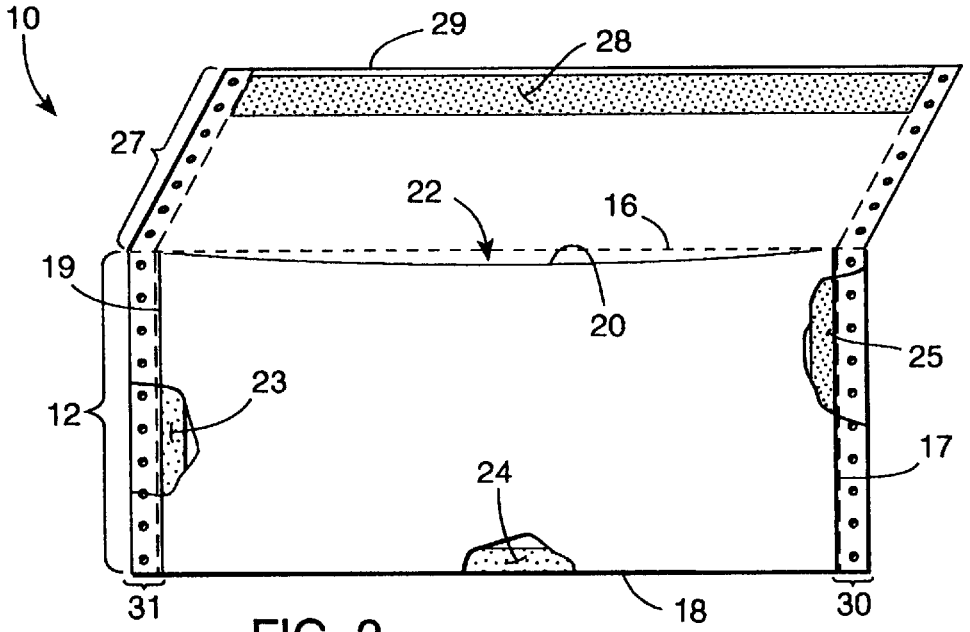
FIG. 2

CERTIFIED MAILER ENVELOPE ASSEMBLY

BACKGROUND AND SUMMARY OF THE INVENTION

The production of envelope assemblies that include paper business forms attached thereto, particularly for return receipt requested mail pieces (such as certified and registered mail, or insured courier delivered packages, etc.) are common. For example, U.S. Pat. No. 4,429,827 to Murray shows a return receipt request attached to the front or back of an envelope which has a window in the side. However, the Murray mailer is not adapted to be used with automatic processing equipment, having no tractor drive holes or the like, and because of the orientation of the return receipt on the envelope difficulties could be encountered in the return receipt being "chewed up" or otherwise adversely acted upon via automatic processing equipment, including printers.

U.S. Pat. No. 2,824,685 shows that it is well known per se to provide tractor drive strips for envelopes, but the envelopes of this patent are not adapted to have forms attached thereto. U.S. Pat. No. 5,183,203 to Sanders discloses automatically processed envelopes which may have certified mail receipts associated therewith, but the certified mail receipts are mounted on the flap of the envelope. Mounting on the flap provides less stability for the envelope assembly during automatic processing, and typically requires the use of more adhesive on the flap to positively hold it in place since the flap must support the weight of the return receipt. Other envelope assemblies with return receipts mounted on the flap, such as shown in U.S. Pat. Nos. 1,491,675 and 1,568,880, have similar problems.

According to the present invention an envelope assembly is provided, which is particularly adapted for return receipt situations (such as certified or registered mail), that has none of the drawbacks of the prior art as described above. The envelope assemblies according to the present invention may be readily automatically processed, with minimal chance of the return receipts being damaged by the automatic processing equipment, with greater ease of handling of the envelope assembly during construction, easy application of the outgoing address indicia thereto, reduced use of adhesive on the envelope flap, and with a number of other advantages, yet the envelope assemblies according to the invention are typically at least as cost effective as those of the prior art.

According to one aspect of the present invention an envelope assembly is provided comprising the following components: A paper envelope comprising a substantially quadrate body having first and second portions with first through fourth edges each with the first and third edges substantially parallel to each other, and the second and fourth edges substantially parallel to each other. The first and second body portions connected together adjacent the first through third edges thereof, and open to define an envelope pocket adjacent the fourth edge thereof. Tractor drive strips provided adjacent the first and third edges of at least one of the body portions. An envelope flap connected to the fourth edge of the first portion of the body and having an adhesive portion remote from the fourth edge of the first body portion. A substantially quadrate paper form having first through fourth edges with the first and third edges substantially parallel to each other, and the second and fourth edges substantially parallel to each other, and first and second faces, the second and fourth edges longer than the first and third edges. Indicia imaged on the form first face. The form connected to the first body portion along both the second and fourth edges and positioned so that the second and fourth edges of the form are substantially parallel to the second and fourth edges of the first body portion, with the form first face facing outwardly. And lines of weakness formed in the form substantially parallel to the second and fourth edges thereof to allow detachment of the form from the envelope by tearing the form along the lines of weakness.

The indicia imaged on the form first face preferably comprises return receipt indicia (such as for certified or registered mail), including a signature line. Also, certified mail indicia may extend from the first body portion to the flap. The form is typically connected to the first body portion by adhesive strips adjacent the second and fourth edges of the form, the lines of weakness being provided immediately adjacent the adhesive strips and on the opposite side of the adhesive strips from the second and fourth edges, respectively.

Typically, the envelope flap is substantially quadrate and has substantially the same width as the first body portion. The tractor drive strips may also be provided adjacent the edges of the flap as a continuation of the tractor drive strips adjacent the first and third edges of the first body portion. Typically, the second body has a width less than that of the first body portion by an amount substantially equal to the widths of the tractor drive strips of the first body portion (the second body portion having no tractor drive strips). In the preferred embodiment the second body portion is adhesively secured to the first body portion adjacent each of the first, second and third edges of the second body portion.

The first body portion and the flap may be formed by an integral piece of paper, with a line of weakness provided at the juncture between the flap and the first body portion. The adhesive portion on the flap may comprise a strip of rewettable adhesive on a section of the flap substantially the most remote from the fourth edge of the first body portion. The strip of adhesive (whether rewettable or of another type) is desirably the only adhesive on the flap (that is no adhesive strips along the side edges of the flap are necessary).

According to another aspect of the present invention an envelope assembly is provided comprising the following components: A paper envelope comprising a substantially quadrate body having first and second portions with first through fourth edges each with the first and third edges substantially parallel to each other, and the second and fourth edges substantially parallel to each other. The first and second body portions connected together adjacent the first through third edges thereof, and open to define an envelope pocket adjacent the fourth edge thereof. Tractor drive strips provided adjacent the first and third edges of at least one of the body portions. An envelope flap connected to the fourth edge of the first portion of the body and having an adhesive portion remote from the fourth edge of the first body portion. An outgoing address imaged or provided on the envelope flap and readily viewable as an outgoing address when the adhesive portion of the flap is sealed to the second body portion. A substantially quadrate paper form having first through fourth edges with the first and third edges substantially parallel to each other, and the second and fourth edges substantially parallel to each other, and first and second faces. Indicia imaged on the form first face. The form connected to the first body portion along both the second and fourth edges, with the form first face facing outwardly. And lines of weakness formed in the form substantially parallel to the second and fourth edges thereof to allow detachment of the form from the envelope by tearing the form along the lines of weakness.

The envelope assembly as described above also preferably has the form positioned thereon so that the second and fourth edges of the form are substantially parallel to the second and fourth edges of the first body portion. This orientation minimizes the chances that the return receipt—which is the preferred construction of the form—will be damaged during automatic processing. Other details of this envelope assembly may be as set forth above.

According to yet another aspect of the present invention an envelope assembly is provided comprising the following components: An envelope comprising a substantially quadrate body having first and second portions with first through fourth substantially continuous edges each with the first and third edges substantially parallel to each other, and the second and fourth edges substantially parallel to each other. The first and second body portions connected together adjacent the first through third edges thereof, and open to define an envelope pocket adjacent the fourth edge thereof. An envelope flap connected to the fourth edge of the first portion of the body and having an adhesive portion remote from the fourth edge of the first body portion, the flap having a maximum dimension from the first portion fourth edge less than the length of the first portion first and third edges. An outgoing address imaged or provided on the envelope flap and readily viewable as an outgoing address when the adhesive portion of the flap is sealed to the second body portion. A paper form having first and second faces. Indicia imaged on the form first face. And the form detachably connected to the first body portion so that the first face is readily visible. The details of the envelope assembly according to this aspect of the invention also may be as set forth above.

It is the primary object of the present invention to provide an advantageous yet effective envelope assembly containing a business form, and most desirably a return receipt. This and other objects of the invention will become clear from an inspection of the detailed description of the invention and from the appended claims.

BRIEF DESCRIPTION OF THE DRAWINGS

FIG. 1 is a rear perspective view of an unsealed envelope assembly according to the present invention;

FIG. 2 is a front perspective view of the envelope assembly of FIG. 1.

DETAILED DESCRIPTION OF THE DRAWINGS

Figure 3:
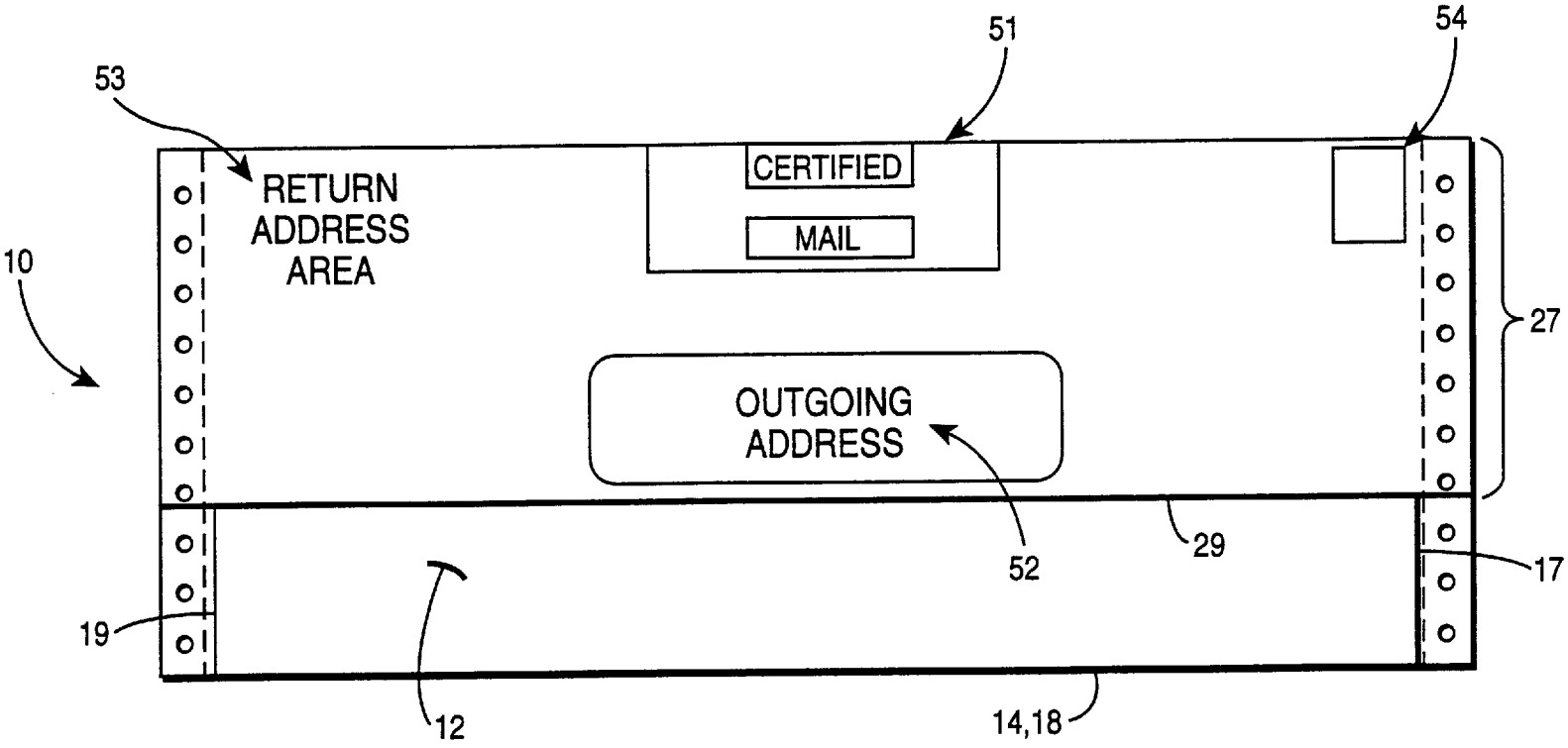
FIG. 3 is a front view of the envelope assembly of FIGS. 1 and 2 when sealed.

An envelope assembly according to the present invention is shown generally by reference numeral 10 in FIGS. 1 through 3. The assembly 10 includes an envelope, preferably of paper, comprising a substantially quadrate body having a first portion 11 (see FIG. 1) and a second portion 12 (see FIG. 2). The first portion 11 has first through fourth edges 13, 14, 15, and 16, respectively, with the first and third edges 13, 15 substantially parallel to each other and the second and fourth edges 14, 16 also substantially parallel to each other, and substantially transverse to the edges 13, 15. The second body portion 12 also has first through fourth edges, denoted by reference numerals 17 through 20, respectively, again the first and third edges 17, 19 being substantially parallel, the second and fourth edges 18, 20 being substantially parallel, and the edges 17, 19 being substantially transverse to the edges 18, 20.

The first and second body portions 11, 12 are connected together adjacent the first through third edges, 13 through 15 and 17 through 19, thereof and open to define an envelope pocket 22 (see FIG. 2) adjacent the fourth edges 16, 20 thereof. The portions 11, 12 are preferably connected together by patterns (e.g. strips) of permanent adhesive, such as the strips 23, 24 and 25 illustrated in FIG. 2—which extend substantially completely along the edges 13 through 15 and/or 17 through 19 and hold the portions 11, 12 together. The adhesive may be any suitable conventional adhesive such as pressure sensitive, rewettable, pressure activated cohesive, heat activated, etc. The edges 16, 20 are substantially adhesive free.

While the adhesive strips 23 through 25 preferably are provided to connect the portions 11, 12 together, other connecting mechanisms may be utilized. For example, the edges 14, 18 instead of being provided by two different pieces of paper may comprise a fold in a continuous sheet of paper, in which case the portions 11, 12 are integral at the edges 14, 18 thereof. Any other suitable conventional means may also be utilized to connect the portions 11, 12 together to define the pocket 22.

The assembly 10 also comprises an envelope flap 27 connected to the fourth edge 16 of the first body portion 11 and having an adhesive portion 28 (see FIG. 2) thereof remote from the edge 16. Because the flap 27 according to the invention does not need to support a return receipt, or a like form, less adhesive can be used than in constructions where the flap does need to support a return receipt form. For example, as illustrated in FIG. 2 a single strip or other pattern of adhesive 28 may be provided at or adjacent the edge 29 of the flap 27 which is most remote from, and substantially parallel to, the edge 16 of the body portion 11. In the preferred embodiment, as illustrated in the drawings, the flap 27 is also quadrate.

The adhesive 28 may comprise any suitable adhesive used on envelope flaps, such as rewettable adhesive, or pressure sensitive adhesive covered by a release strip, or any other conventional construction. The connection between the flap 27 and the first body portion 11 may also comprise any conventional construction. In the configuration illustrated in the drawings the flap 27 is an integral piece of paper with the main body portion 11, and the edge 16 is a line of weakness (such as a score line, perforation line, crease line, etc.) allowing the flap 27 to fold over easily and precisely, and allowing separation to occur between the flap 27 and the first body portion 11. In the exemplary embodiment illustrated in FIGS. 1 and 2 the connecting line—which is the same as the fourth edge 16—is a perforation line.

In order to provide for automatic processing of the envelope assembly 10, utilizing conventional automatic equipment including drive and printer equipment, tractor drive strips are provided. As illustrated in the drawings, the tractor drive strips 30, 31 may be provided, which are entirely conventional. The tractor drive strips 30, 31 are adjacent the first and third edges 13, 15 and/or 17, 19, of one or both of the body portions 11, 12. In the preferred embodiment illustrated in the drawings, the tractor drive strips 30, 31 are formed from an integral piece of paper with the first body portion 11 and the flap 27, but not the second body portion 12. As is conventional, the tractor drive strips 30, 31 are preferably detachable from the main body portion 11 and the flap 27 along lines of weakness, such as perforation lines. In FIG. 1 the perforation lines 13, 15 are coextensive with the edges 13, 15 of the first body portion 11, while in all of the figures the perforation lines 33, 34 provided in the flap 27 allow detachment of the tractor drive strips 30, 31 from the flap 27 too.

While in the preferred embodiment the tractor drive strips 30, 31 are not provided as part of the second body portion 12, tractor drive strips comparable to the strips 30, 31 may also be provided in the body portion 12, or in the body portion 12 instead of in the body portion 11 and/or the flap 27.

The assembly 10 also comprises a substantially quadrate paper form, shown generally by reference numeral 36 in FIG. 1, having first through fourth edges 37, 38, 39, 40, respectively. The first and third edges 37, 39 are substantially parallel to each other and substantially perpendicular to the second and fourth edges 38, 40. The form 36 has a first face 41 visible in FIG. 1, and a second face (opposite the face 41 and not visible in FIG. 1). Typically both faces of the form 36 will be imaged, but certainly indicia is imaged on the first face 41 and is visible from the outside of the assembly 10. Any suitable indicia may be provided, but in the preferred embodiment the form 36 is a conventional return receipt form, such as a certified mail or registered return receipt form, and includes (among other conventional elements) some sort of return receipt indicia 42 and a signature line 43. Any other suitable and/or conventional indicia may be provided.

In the preferred embodiment the form 36 is connected to the first body portion 11, as illustrated in FIG. 1. While a number of different conventional connection techniques may be utilized, in the preferred embodiment illustrated in FIG. 1 adhesive patterns or strips 44, 45 are provided for connecting the form 36 to the envelope body portion 11. In the preferred embodiment illustrated in FIG. 1 the adhesive strips 44, 45 are disposed adjacent the edges 38, 40, and the edges 38, 40 are longer than the edges 37, 39, and the edges 38, 40 are parallel to the edges 14, 16, 18, and 20. By providing this construction the form 36 is much more secure on the envelope than if the connecting adhesive were provided adjacent the edges 37, 39 both because a larger area of adhesive is provided, but primarily the orientation of the adhesive strips 44, 45 are such that when the envelope assembly is being processed and moved by the automatic equipment engaging the tractor drive strips 30, 31—such as in the direction 47 schematically illustrated in FIG. 1—there will be no free edge (the edges 37, 39 are free edges with no adhesive or other connecting elements) that can be engaged easily by the automatic equipment, such as a printer or drive mechanisms, and therefore there is less chance that the form 36 will be "chewed up" or otherwise damaged by the automatic processing equipment. Also by providing the form 36 on the first body portion 11 rather than the flap 27 less adhesive is needed on the flap 27 (only the strip 28, instead of strips also going along the side edges of the flap 27 as is conventional when flap mounted return receipt forms are utilized), and there is greater stability to the entire assembly 10 during handling.

As is conventional lines of weakness 48, 49—such as perforation lines—are formed in the form 36 substantially parallel to the second and fourth edges 38, 40 to allow ready detachment of the return receipt form 36 from the first body portion 11 after a signature has been applied at indicia 43. The lines of weakness 48, 49 are on the opposite sides of the adhesive strips 44, 45 from the edges 38, 40.

The form 36 is typically applied to the first body portion 11 during automatic processing of the envelope assembly 10 using conventional "tip on" equipment.

The envelope assembly 10 also preferably comprises a known certified mail (assuming that the form 36 is a certified mail return receipt form) indicia element 51 which spans the body portion 11 and the flap 27. This indicia 51 may be in the form of a label, or may simply be printed onto the body portion 11 and flap 27 during automatic processing of the envelope assembly 10.

According to the present invention an outgoing address is preferably provided on the flap 27. That is outgoing address indicia—as illustrated at 52 in FIGS. 1 and 3—is either imaged directly on the flap 27 (which is preferred), or applied thereto by a label or in other conventional manners. The flap 27 also preferably includes a return address area 53—which may either have blanks or lines for a return address, or have the actual return address imaged thereon—and a postage application area 54. The postage application area 54 may be indicia such as a permit number which provides actual postage, or may simply be a blank area, or may include word indicia indicating that postage (such as a stamp or metering) is to be applied thereat. The indicia 51–54 have the same orientation when the final envelope assembly 10 is constructed, as shown in FIG. 3.

In the construction of the final sealed envelope assembly 10 as illustrated in FIG. 3, after processing on the automatic equipment, or as part of the processing on the automatic equipment, any insert to be provided in the envelope is inserted into the pocket 22 between the body portions 11, 12. Then the flap 27 is folded about the line/edge 16 to the position in which the adhesive 28 is in contact with the envelope body portion 12. The adhesive 28 is appropriately activated—such as by applying water to it, or removing a release strip—and then the adhesive strip 28 is pressed into contact with the body portion 12. The return receipt form 36 is then on the opposite side of the envelope assembly 10 from the outgoing address 52.

While in the final form of the envelope assembly illustrated in FIG. 3 the tractor drive strips 30, 31 are shown, in most instances the tractor drive strips 30, 31 will be removed by tearing along the lines of weakness 13, 15, 33, 34 and removed before the assembly 10 is actually mailed.

When the envelope assembly 10 is received at the final destination (at the outgoing addressee's address), the recipient signs at the indicia 43, the form 36 is detached along the lines of weakness 48, 49, and the return receipt 26 is returned to the mailer.

While the envelope assembly 10 may have almost any dimensions (at least so that it can be handled normally by the postal service), the first body portion 11 and the flap 27 are typically formed from a single sheet of continuous paper approximately 11 inches by 10 inches with one-half inch perforations left and right. The second body portion 12 may then be formed from a 10 inch by 5¾ inch sheet of paper that is pasted on the body portion 11. The form 36 typically is green in color and has indicia corresponding to the conventional "3811" postal service form.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as encompass all equivalent structures and products.

What is claimed is:

1. An envelope assembly comprising:

an envelope comprising a substantially quadrate body having first and second portions with first through fourth substantially continuous edges each with said first and third edges substantially parallel to each other, and said second and fourth edges substantially parallel to each other;

said first and second body portions connected together adjacent said first through third edges thereof, and open to define an envelope pocket adjacent said fourth edge thereof;

an envelope flap connected to said fourth edge of said first portion of said body and having an adhesive portion remote from said fourth edge of said first body portion, said flap having a maximum dimension from said first portion fourth edge less than the length of said first portion first and third edges;

an outgoing address imaged or provided on said envelope flap and readily viewable as an outgoing address when said adhesive portion of said flap is sealed to said second body portion;

a paper form having first and second faces;

indicia imaged on said form first face; and said form detachably connected to said first body portion so that said first face is readily visible.

2. An envelope assembly as recited in claim 1 wherein said indicia imaged on said form first face comprises return receipt indicia, including a signature line.

3. An envelope assembly as recited in claim 2 wherein said adhesive portion of said flap comprises a strip of rewettable adhesive on a section of said flap substantially the most remote from said fourth edge of said first body portion, and wherein said rewettable adhesive strip is the only adhesive on said flap.

4. An envelope assembly comprising:

a paper envelope comprising a substantially quadrate body having first and second portions with first through fourth edges each with said first and third edges substantially parallel to each other, and said second and fourth edges substantially parallel to each other;

said first and second body portions connected together adjacent said first through third edges thereof, and open to define an envelope pocket adjacent said fourth edge thereof;

tractor drive strips provided adjacent said first and third edges of at least one of said body portions;

an envelope flap connected to said fourth edge of said first portion of said body and having an adhesive portion remote from said fourth edge of said first body portion;

an outgoing address imaged or provided on said envelope flap and readily viewable as an outgoing address when said adhesive portion of said flap is sealed to said second body portion;

a substantially quadrate paper form having first through fourth edges with said first and third edges substantially parallel to each other, and said second and fourth edges substantially parallel to each other, and first and second faces;

indicia imaged on said form first face;

said form connected to said first body portion along both said second and fourth edges, with said form first face facing outwardly; and lines of weakness formed in said form substantially parallel to said second and fourth edges thereof to allow detachment of said form from said envelope by tearing said form along said lines of weakness.

5. An envelope assembly as recited in claim 4 wherein said form is positioned so that said second and fourth edges of said form are substantially parallel to said second and fourth edges of said first body portion.

6. An envelope assembly as recited in claim 4 wherein said indicia imaged on said form first face comprises return receipt indicia, including a signature line.

7. An envelope assembly as recited in claim 6 further comprising certified mail indicia extending from said first body portion to said flap.

8. An envelope assembly as recited in claim 4 wherein said form is connected to said first body portion by adhesive strips adjacent said second and fourth edges of said form, said lines of weakness provided immediately adjacent said adhesive strips on the opposite sides of said adhesive strips from said second and fourth edges, respectively.

9. An envelope assembly as recited in claim 4 wherein said envelope flap is substantially quadrate and has substantially the same width as said first body portion, and wherein said tractor drive strips are also provided adjacent edges of said flap as a continuation of the tractor drive strips adjacent said first and third edges of said first body portion.

10. An envelope assembly as recited in claim 4 wherein said adhesive portion of said flap comprises a strip of rewettable adhesive on a section of said flap substantially the most remote from said fourth edge of said first body portion, and wherein said rewettable adhesive strip is the only adhesive on said flap.

11. An envelope assembly as recited in claim 10 wherein said first body portion and said flap are an integral piece of paper, and wherein a line of weakness is provided at a juncture between said flap and first body portion.

12. An envelope assembly comprising:

a paper envelope comprising a substantially quadrate body having first and second portions with first through fourth edges each with said first and third edges substantially parallel to each other, and said second and fourth edges substantially parallel to each other;

said first and second body portions connected together adjacent said first through third edges thereof, and open to define an envelope pocket adjacent said fourth edge thereof;

tractor drive strips provided adjacent said first and third edges of at least one of said body portions;

an envelope flap connected to said fourth edge of said first portion of said body and having an adhesive portion remote from said fourth edge of said first body portion;

a substantially quadrate paper form having first through fourth edges with said first and third edges substantially parallel to each other, and said second and fourth edges substantially parallel to each other, and first and second faces, said second and fourth edges longer than said first and third edges;

indicia imaged on said form first face;

said form connected to said first body portion along both said second and fourth edges and positioned so that said second and fourth edges of said form are substantially parallel to said second and fourth edges of said first body portion, with said form first face facing outwardly; and lines of weakness formed in said form substantially parallel to said second and fourth edges thereof to allow detachment of said form from said envelope by tearing said form along said lines of weakness.

13. An envelope assembly as recited in claim 12 wherein said indicia imaged on said form first face comprises return receipt indicia, including a signature line.

14. An envelope assembly as recited in claim 13 further comprising certified mail indicia extending from said first body portion to said flap.

15. An envelope assembly as recited in claim 12 wherein said form is connected to said first body portion by adhesive strips adjacent said second and fourth edges of said form, said lines of weakness provided immediately adjacent said adhesive strips on the opposite sides of said adhesive strips from said second and fourth edges, respectively.

16. An envelope assembly as recited in claim 12 wherein said envelope flap is substantially quadrate and has substantially the same width as said first body portion, and wherein said tractor drive strips are also provided adjacent edges of said flap as a continuation of the tractor drive strips adjacent said first and third edges of said first body portion.

17. An envelope assembly as recited in claim 16 wherein said second body portion has a width less than that of said first body portion by an amount substantially equal to the widths of said tractor drive strips of said first body portion, said second body portion having no tractor drive strips.

18. An envelope assembly as recited in claim 17 wherein said second body portion is adhesively secured to said first body portion adjacent each of said first, second, and third edges of said second body portion.

19. An envelope assembly as recited in claim 12 wherein said adhesive portion of said flap comprises a strip of rewettable adhesive on a section of said flap substantially the most remote from said fourth edge of said first body portion, and wherein said rewettable adhesive strip is the only adhesive on said flap.

20. An envelope assembly as recited in claim 12 wherein said first body portion and said flap are an integral piece of paper, and wherein a line of weakness is provided at a juncture between said flap and first body portion.

* * * * *